United States Patent [19]

Rudy

[11] 4,344,075

[45] Aug. 10, 1982

[54] TIMING CIRCUIT FOR THE DIGITAL GENERATION OF COMPOSITE LUMINANCE AND CHROMINANCE VIDEO SIGNAL FOR NON-INTERLACED TELEVISION RASTER SCAN-LINE PATTERN

[75] Inventor: John E. Rudy, Lancaster, Pa.

[73] Assignee: RCA Corporation, New York, N.Y.

[21] Appl. No.: 181,984

[22] Filed: Aug. 28, 1980

[51] Int. Cl.[3] ..... G09G 1/28

[52] U.S. Cl. ..... 340/703; 340/814; 358/152

[58] Field of Search ..... 340/703, 814, 798; 358/152, 17

[56] References Cited

U.S. PATENT DOCUMENTS

| | | | |
|---|---|---|---|
| 3,422,223 | 1/1969 | Scipione | 358/152 |
| 3,944,993 | 3/1976 | Dalke et al. | 340/703 |
| 3,944,997 | 3/1976 | Swallow | 340/703 |
| 4,136,359 | 1/1979 | Wozniak | 358/17 |
| 4,150,364 | 4/1979 | Baltzer | 340/703 |
| 4,247,865 | 1/1981 | Mastronardi | 358/17 |

*Primary Examiner*—Marshall M. Curtis

*Attorney, Agent, or Firm*—Samuel Cohen; Joseph S. Tripoli; George J. Seligsohn

[57] ABSTRACT

Ragged vertical edges normally displayed by a NTSC color-carrier on a non-interlaced display are effectively eliminated through persistence of vision by altering the duration of a selected single scan-line of the non-display portion of each of successive fields by an odd number of half-cycles of the NTSC color-carrier frequency.

11 Claims, 4 Drawing Figures

Figure 1:
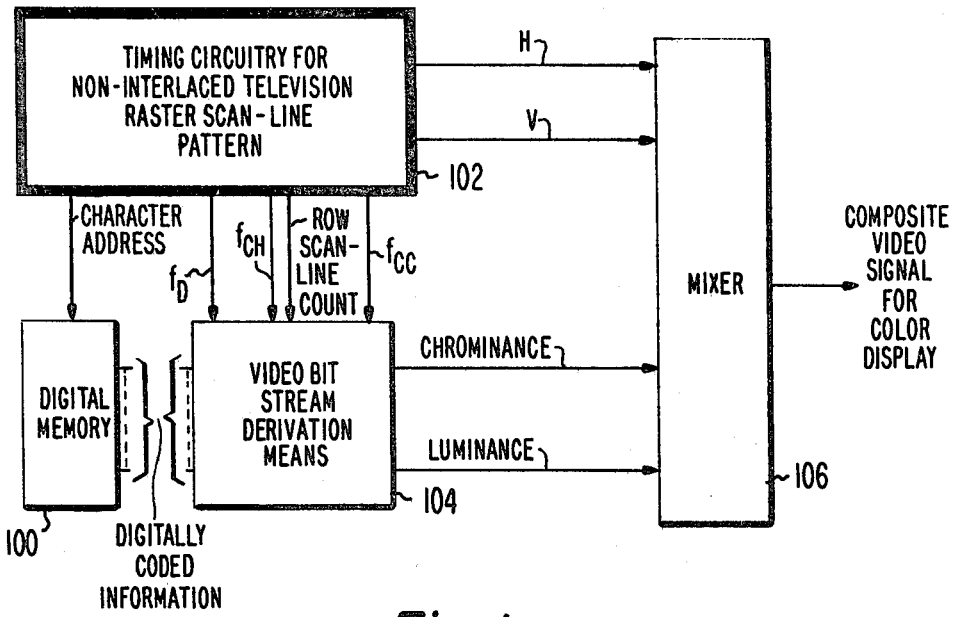

TIMING CIRCUIT FOR THE DIGITAL GENERATION OF COMPOSITE LUMINANCE AND CHROMINANCE VIDEO SIGNAL FOR NON-INTERLACED TELEVISION RASTER SCAN-LINE PATTERN

This invention relates to a system for digitally generating a composite luminance and chrominance video signal for display on a display device that exhibits a non-interlaced television raster scan-line pattern and, more particularly, to timing circuitry therefor.

The term "television raster scan-line pattern," as used herein, is generic to the type of visual display of a two-dimensional picture that is produced by a single modulated flying spot, during each of repetitive frames, traversing each of a plurality of substantially parallel scan lines. The single flying spot may take various forms. By way of examples, it may take the form of one or more scanning electron beams impinging on the phosphor screen of a monochrome or a shadow-mask color CRT or, alternatively, it may comprise one or more beams of light. Furthermore, the order in which the scan lines of a frame are scanned by the single flying spot is of no significance. A raster scan-line pattern frame may be comprised of a single non-interlaced field, two interlaced fields (as in NTSC television), three interlaced fields, etc.

Video terminals for digitally generating a video signal for use in displaying a message comprised of a plurality of character patterns on a display device that exhibits a television raster scan-line pattern are known in the art. An example of such a video terminal is disclosed in U.S. Pat. No. 3,345,458. In such a video terminal, each character pattern (which may be an alphanumeric symbol, a graphic symbol, etc.) is displayed in dot matrix form within a two-dimensional character space. A first dimension of each character space comprises a first assigned number of dots oriented along a scan line and a second dimension of a character space comprises a second assigned number of consecutive scan lines. The digitally-generated video signal may be solely a luminance video signal for display of the character patterns of the message in black-and-white or, alternatively, it may be a composite video signal defining both luminance and chrominance information for displaying the character patterns of the message in color. In the latter case, the foreground and/or the background of each character pattern is conventionally displayable in a selected one of eight different colors. These eight different colors (i.e., black, red, blue, green, magenta, cyan, yellow and white) may be digitally represented by a three-bit digital code.

Although not limited thereto, it is often desirable that the display device for the digitally-generated video signal be a standard monochrome or color television monitor or television set, as the case may be. In the United States, such standard television monitors and television sets are designed in accordance with NTSC standards. These standards comprise a frame of 525 lines consisting of two interlaced fields of 262.5 lines each. In the case of monochrome, the NTSC scan-line frequency is 15,750 scan-lines per second. However, in the case of color, which employs a precise NTSC reference color carrier frequency of 3.579545 megahertz (MHz), the scan-line frequency is chosen at the closest value to 15,570 scan lines per second for which the color carrier frequency is an odd harmonic of one-half this chosen scan-line frequency. As it turns out, this odd harmonic is 455 and the closest scan-line frequency, itself is substantially 15,734 scan lines per second. In addition, in accordance with NTSC standards, scan lines are oriented substantially in the horizontal direction. In principle, however, the orientation direction of the scan lines is immaterial.

There are certain benefits to be gained by employing a non-interlaced television raster scan-line pattern for the display of a digitally-generated video signal in a video terminal. First, it simplifies somewhat the design of the video terminal. Second, and more important, the use of an interlaced television raster scan-line pattern, to display a stationary image of a message comprised of character patterns, exhibits a perceptible amount of flicker. This flicker is eliminated by employing a non-interlaced television raster scan-line pattern. However, the use of a non-interlaced television raster scan-line pattern with a color monitor or television set designed to operate in accordance with NTSC standards creates a problem. First, a non-interlaced television raster scan-line pattern requires that each field be comprised of a whole number of scan lines. Employing 263 scan lines per field, rather than 262.5, is no good because it is difficult to hold vertical sync in the television set or monitor with even this slightly lower field frequency. Therefore, it is necessary to reduce the number of scan lines per field from 262.5 to 262, which is an even whole number. In this case, the color carrier varies in phase between successive scan lines by 180°.This results in ragged vertical edges in the color display of message character patterns. One solution to this problem, disclosed in U.S. Pat. No. 4,136,359, is to delay the beginning of each scan line by an odd number of half-cycles of the color-carrier frequency. Although this prior art solution overcomes the problem of vertical ragged edges, it has been found that, as a side effect, it introduces a new problem of adding spurious color into those characters that are intended to be displayed as white. The present invention is directed to a novel solution to the problem of ragged vertical edges which does not introduce as a side effect the above or other problems.

Briefly, in accordance with the principles of the present invention, timing control means are provided which are operative only during a selected single scan line of a non-display portion of each successive field of a given non-interlaced television raster scan-line pattern. Such timing control means alters the occurrence of the display portion of the next successive field by an amount substantially equal to a given odd number of half-cycles of the color-carrier frequency. This results in the ragged edges of the second of any two successive fields being 180° out-of-phase with the corresponding ragged edges of the first of the two successive fields. Since the field frequency is sufficiently high (approximately 60 Hz in NTSC systems), integration of the 180° out-of-phase ragged edges of successive fields, due to persistance of vision of the viewer, effectively overcomes the problem of ragged edges.

Figure 1A:
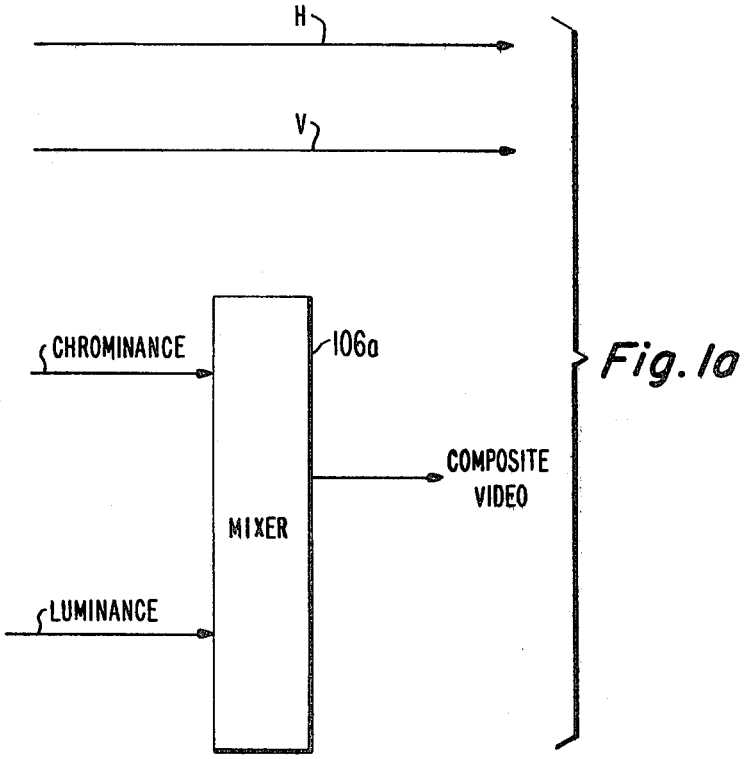
Figure 2:
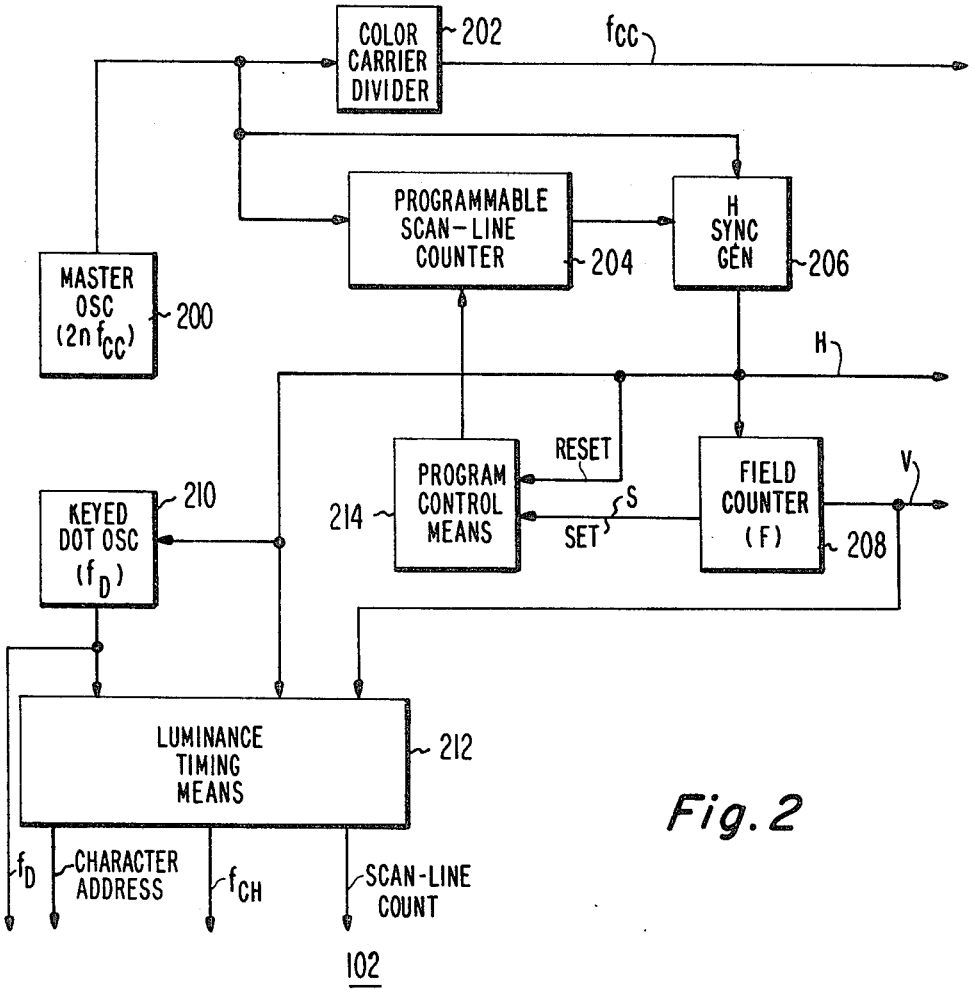
Figure 2A:
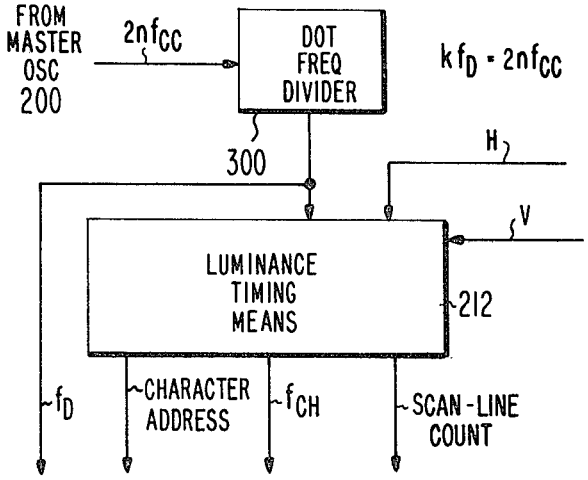

In the drawings:

FIG. 1 is a functional block diagram of a typical system for digitally generating a composite video signal defining luminance and chrominance information that is to be displayed in color on a color display device that at a field frequency exhibits successive fields of a given non-interlaced television raster scan-line pattern;

FIG. 1*a* illustrates a modification of the system shown in FIG. 1;

FIG. 2 is a block diagram of an illustrative embodiment of the timing circuitry of the system shown in FIG. 1, which timing circuitry incorporates the present invention;

FIG. 2*a* illustrates a modification of the embodiment shown in FIG. 2.

The system shown in FIG. 1 derives a composite video signal for displaying in color a message composed of character patterns in dot matrix form on a display device that exhibits a television raster scan-line pattern. The message information is originally stored in digitally-coded form in digital memory 100. Timing circuitry for a non-interlaced television raster scan-line pattern 102 derives seven timing signals. These seven timing signals comprise a color-carrier frequency signal $f_{CC}$, a horizontal sync signal H, a vertical sync signal V, a character address signal, a row scan-line count, a character dot frequency signal $f_D$, and a character repetition frequency signal $f_{CH}$. The H, V, $f_{CH}$, $f_D$, $f_{CC}$, the character address signal and the scan-line count timing signals all occur in substantially time-synchronous relationship with respect to each other. The duration of a period of $f_{CH}$ is substantially equal to the scanning time in the scan-line direction (e.g., the horizontal direction) through one character width. Each character width comprises a first assigned number of dots and a count of $f_D$ indicates the ordinal position within any character width of a dot then being scanned through. In a direction orthogonal to the scan-line direction (e.g., the vertical direction), a row of characters is comprised of a second assigned number of scan lines. A row scan-line count indicates the original position within a row of the scan line then being scanned.

Digital memory 100, at the character repetition rate $f_{CH}$, reads out a multi-bit word of digitally-coded information selected by the character address signal which defines the character to be displayed. One portion of this digitally coded information may be, for example, a 6 or 7 bit ASCII code which identifies the particular character then being read out from an alphabet of 64 ($2^6$) or 128 ($2^7$) different characters, as the case may be. Another portion of the digitally coded information may be a three-bit code that specifies the particular foreground color of the character beam then being read out from a group of eight different colors, as discussed above. If desired, the digitally-coded information also may include another three-bit code specifying a particular background color of the character then being read out. Further, the digitally-coded information may include additional bits for selecting other attributes of the character then being read out, as known in the art.

In any case, the digitally-coded information output from digital memory 100 is applied at the character repetition rate $f_{CH}$ as an input to video bit stream derivation means 104. The character dot frequency $f_D$ scan-line count and the color-carrier $f_{CC}$ are also applied as inputs to video bit stream derivation means 104.

Video bit stream derivation means 104 includes digital translation means responsive to the characterportion (ASCII code) of the digitally coded information, the scan-line count and the character dot frequency for deriving the luninance output thereof. As known in the art, such digital translation means may comprise a character generator read-only-memory (ROM) together with a shift register clocked by $f_D$ operating as a parallel-to-serial converter for deriving in dot matrix form a series of successively-occurring dots corresponding to the character width of the character then being read out from digital memory 100 during the then-occurring scan line. Such a series of dots for each successive message character of a row comprises the luminance output from video bit stream derivation means 104.

Video bit stream derivation means 104 also includes a color modulator which modulates the color carrier $f_{CC}$ to produce an appropriate chrominance signal as determined by the color portion of the digitally-coded information for the character then being read out from digital memory 100. This color portion of the digitally-coded information for the character may also be used to adjust the luminance level, which also determines the resultant color. In any case, the modulated carrier frequency comprises the chrominance output of video bit stream derivation means 104. For illustrative purposes, it is assumed that the color modulator of video bit stream derivation means 104 together with the H and V sync signals from timing circuitry 102 are combined in mixer 106 into a composite video signal for color display. This composite video signal may be applied directly to the video input of a monitor or, alternatively, it may be up-converted to a television channel carrier frequency by an RF modulator and then applied to the antenna terminals of a conventional color television set (assuming that the chrominance signal is, in fact, an NTSC signal). In the latter case, the color carrier frequency $f_{CC}$ is often known as the color subcarrier, in order to distinguish it from the RF carrier. As used herein, the term "color-carrier frequency" is synonomous with the term "color subcarrier frequency".

In some cases the H and V sync signals are not mixed with the video signal. Instead, the H sync signal is applied directly to the horizontal deflection circuitry of the display device and the V sync signal is applied directly to the vertical deflection of the circuitry of the display device. FIG. 1*a* shows a modification of FIG. 1 in which this is the case. The chrominance and luminance output from video bit stream derivation means are combined in mixer **106*a* to provide a composite video, but the H and V sync signals from timing circuitry 102 are not applied to mixer 106*a***. The term "composite video", as used herein, is generic to the arrangements shown in both FIGS. 1 and 1*a*.

An embodiment of timing circuitry 102 which incorporates an embodiment of the present invention is shown in FIG. 2. Referring to FIG. 2, the circuitry 102 includes master oscillator 200 for deriving clock signals having a frequency substantially equal to 2n times the color-carrier frequency $f_{CC}$, where n is positive integer. The clock signals from master oscillator 200 are applied as respective inputs to color-carrier divider 202, programmable scan-line counter 204 and horizontal (H) sync generator 206. An output from programmable scan-line counter 204 is also applied as an input to H sync generator 206. The output from H sync generator 206, which externally constitutes the H sync output from timing circuitry 102, is also applied internally as respective inputs to field counter 208, keyed dot oscillator 210, luminance timing means 212 and program control means 214. A first output V from field counter 208, which externally constitutes the vertical (V) sync output from timing circuitry 102, is also applied internally as the second input to luminance timing means 212. A second output S from field counter 208 is internally applied as a second input to program control means 214. The output from program control means 214 is applied as a program control input to programmable scan-line counter 204. The output from keyed dot oscillator 210 which externally constitutes the $f_D$ output from timing circuitry 102 is also applied internally as a third input to luminance timing means 212.

Color-carrier divider 202 divides the clock signal input thereto by 2n to provide a color-carrier frequency signal $f_{CC}$ as a first timing signal occurring in time synchronous relationship with the clock signals.

A field consists of F successive scan lines. Field counter 208, in response to F successive H sync signals applied as an input thereto, derives, as a second timing signal, its V sync signal output. Thus, the V sync signal recurs at the field frequency.

In accordance with the principles of the present invention, F is a predetermined even whole number. Further, a message is displayed only during a display portion of each field, which display portion comprises an ordinal subset of certain consecutive scan lines of the set of F scan lines of the field. A subset comprising the remainder of the scan lines of each field constitutes a non-display portion of that field. During the non-display portion of a field, which includes the vertical flyback time and may also include upper and lower margins for the displayed message, the luminance signal will contain no character dot information, as is known in the art. In response to a selected single scan line of the non-display portion of each field being counted by field counter 208, field counter 208 derives its second output S.

Program control means 214, which may be a flip-flop, is set at the beginning of the selected single scan line of each field in response to the leading edge of output S from field counter 208 being applied thereto. At the end of the selected single scan-line of each field, program control means 214 is reset by the application thereto of an H sync signal. Program control means 214, in its reset state, maintains programmable scan-line counter 204 in a first programmed condition thereof and in its set state maintains programmable scan-line counter 204 in a second programmed condition thereof. Thus, programmable scan-line 204 is maintained in its second programmed condition only in response to field counter 208 registering that particular count which corresponds to the selected single scan line and is maintained in its first programmed condition in response to the field counter registering a count other than that particular count.

In its first programmed condition, programmable scan-line counter 204 produces an output signal in response to counting n times a first given odd number of clock signals applied as an input thereto. Therefore, in its first programmed condition, programmable scan-line counter derives a scan-line frequency such that the color-carrier frequency $f_{CC}$ is a certain (i.e., first given number) odd harmonic of one-half the scan-line frequency.

Programmable scan-line counter 204, in its second programmed condition, derives an output therefrom in response to counting a second given number of clock signals applied as an input thereto, which second given number differs from the aforesaid first given odd number by n times a third given odd number. Therefore, the duration of a scan-line period with programmable scan-line counter 204 in its second programmed condition differs from that in its first programmed condition by an odd number of half-cycles of the color-carrier frequency signal $f_{CC}$.

H sync generator 206 includes a coincidence gate responsive to the presence of both a clock signal and an output from programmable scan-line counter 204. This results in the H sync output from generator 206 comprising a third timing signal which occurs in time synchronous relationship with the clock signals.

In the embodiment shown in FIG. 2, keyed dot oscillator 210 generates dot timing signals at a frequency $f_D$. Frequency $f_D$ is relatively low compared to the color-carrier frequency $f_{CC}$. However, it is high relative to the character repetition frequency $f_{CH}$ (which, in turn, is high relative to the scan-line frequency). Because dot frequency $f_D$ is not derived from the clock signals produced by master oscillator 200, but is independently generated by keyed dot oscillator 210, it is necessary to provide external timing synchronization between dot oscillator 210 and a timing signal derived from the clock signals. This is accomplished by momentarily keying dot oscillator 210 off in response to each H sync signal.

Luminance timing means 212, in response to the dot frequency signal $f_D$, the vertical sync signal V and the horizontal sync signal H, all applied as inputs thereto, derives the character address signal and the $f_{CH}$ and the scan-line count outputs from timing circuitry 102. Specifically, $f_{CH}$ is derived by frequency dividing the dot-clock frequency $f_D$ by the assigned number of dots in a character width and is restricted to occur only during the times when character information is to be displayed. The character address signal is derived from a counter initialized by V sync and is clocked by a separate signal which mirrors $f_{CH}$ but is phase-displaced, leading the $f_{CH}$ output of luminance timing means 212 by one or more dot periods. The scan-line count may be derived by a cyclical counter within luminance timing means 212 having a count capacity equal to the number of scan lines in a displayed character row. This cyclic counter counts the number of H sync signals applied as an input thereto. Luminance timing means 212 for use in a video terminal are known in the art.

In the following discussion of the operation of the embodiment shown in FIG. 2, it is assumed that NTSC standards apply and it is further assumed that the value of n is 1. This latter assumption makes it possible to operate master oscillator 200 at its lowest permissable frequency of twice the color-carrier frequency signal $f_{CC}$. Based on the foregoing assumptions, master oscillator 200 produces clock signals at a nominal frequency of 7.15909 MHz, which is twice the NTSC color-carrier frequencies standard of 3.579545 MHz. In this case, programmable scan-line counter 204 may comprise a non-programmable divide-by-seven counter cascaded with a programmable counter which is a divide-by-sixty-five counter in its first programmed condition and is a divide-by-sixty-four counter in its second programmed condition. Thus, its first programmed condition, programmable scan-line counter 204 divides the clock signal input frequency thereto of 7.14909 MHz by 455 to provide the proper NTSC scan-line frequency of substantially 15,734 Hz. However, in its second programmed condition, programmable scan-line counter divides the clock signal input frequency thereto of 7.15909 MHz by 448, rather than 455. The effect thereof is to decrease the period of a scan-line by seven periods of the clock signal (i.e., 7 half-cycles of the color-carrier frequency signal $f_{CC}$) with respect to the period of a scan-line in the first programmed condition of programmable scan-line counter 204.

If the predetermined even whole number F of scan lines comprising a field is assumed to be 262 (the predetermined even whole number closest to the NTSC standard of 262.5 scan lines field) and the selected single scan-line is assumed to be line 229 (situated within the non-display portion of a field), line 229 will be composed of only 448 cycles of the 7.15909 MHz clock signals (or 448 half-cycles of the NTSC color-carrier frequency of 3.579545 MHz), while the remaining 261 lines of a field will be comprised of 455 cycles of the 7.15909 MHz clock signals (or 455 half-cycles of the NTSC color-carrier frequency). The effect is to alter (i.e., reduce) the relatively long field period (nominally about 60 Hz) by substantially exactly 7 half-cycles of the relatively high color-carrier frequency signal (3.579545 MHz). This insures that the respective color-carrier frequency components of corresponding ones of the non-interlaced scan lines of successive field will be 180° out-of-phase with each other (thereby integrating out through persistence of vision of a viewer any ragged vertical edges or color decoder error present in the viewed display.)

The present invention can be incorporated in a system which is designed to operate with a standard television set as the display device. A standard television set has a limited video bandwidth. In order to display a relatively high density of characters, the dot frequency $f_D$ should be relatively high, but still well within the video bandwidth of a television set. Furthermore, the dot frequency should not produce a noticeable beat frequency with the color-carrier frequency. When n has a value of 1, so that the clock signals have a frequency of only twice the color-carrier frequency, there is no sub-harmonic of the clock frequency that meets all of these constraints. Therefore, in the arrangement shown in FIG. 2, it is necessary to employ an independent dot oscillator for generating the dot frequency $f_D$. However, it is also essential that the dot frequency occur in time synchronous relationship with the H sync signals, which H sync signals are derived from the clock signals. For this reason, in FIG. 2, dot oscillator 210 is a keyed dot oscillator which is momentarily keyed off by the H sync signal at the end of each scan line.

FIG. 2*a* illustrates a modification of the embodiment shown in FIG. 2, in which it is assumed that n is a plural integer (and, preferably, a relatively large plural integer). In this case, it is possible to derive a dot frequency $f_D$ that is a specified sub-multiple k of the clock signal frequency $2nf_{CC}$, and still meet all the constraints discussed above. Thus, as shown in FIG. 2*a*, the dot frequency $f_D$ (which is applied as an input to luminance timing means 212) is derived from the clock signals from master oscillator 200 by means of dot frequency divider 300. As indicated in FIG. 2*a*, dot frequency divider 300 divides the clock signal frequency by k (so that k times the dot frequency $f_D$ is equal to the clock signal frequency $2nf_{CC}$.

What is claimed is:

1. In a system incorporating generating means for digitally generating a composite video signal defining luminance and chrominance information that is to be displayed in color on a color display device that at a field frequency exhibits successive fields of a given non-interlaced television raster scan-line pattern, wherein each field is composed of a predetermined even whole number of scan lines of which an ordinal subset of certain consecutive scan lines of each field comprises a display portion of that field and a subset comprising the remainder of the scan lines of each field constitutes a non-display portion of that field, and wherein said composite video signal includes a specified color-carrier frequency that is substantially equal in value to one-half a certain odd harmonic of that scan-line frequency which exists during the entire display portion of that field, the improvement wherein said generating means comprises:

timing control means operative only during a selected single scan line of the non-display portion of each field for altering the beginning of the display portion of the next successive field by an amount substantially equal to a given odd number of half-cycles of said specified color-carrier frequency.

2. The system defined in claim 1, wherein said predetermined whole number is 262 and said specified color-carrier frequency is the NTSC standard of nominally 3.579545 megahertz.

3. The system defined in claim 1, wherein said system comprises timing circuitry including clock means for producing clock signals at a master frequency substantially equal to 2n times said color-carrier frequency, wherein n is a preselected positive integer, and frequency divider means coupled to said clock means for deriving first, second and third timing signals in time synchronous relationship with said clock signals, said first timing signal occurring periodically at the end of each period of said color-carrier frequency, said second timing signal occurring periodically at the end of each period of said field frequency and said third timing occurring at the end of each scan line of a field, and wherein said frequency divider means includes said timing control means.

4. The system defined in claim 3, wherein the value of n is one.

5. The system defined in claim 3, wherein said timing control means includes a field counter for producing said second timing signal in response to said field counter having counted a series of successive input signals thereto equal in number to said predetermined even whole number, a programmable scan-line counter for producing a third timing signal in response to said scan-line counter (1) in a first programmed condition thereof having counted a series of successive input signals thereto equal in number to n times said certain odd harmonic and (2) in a second programmed condition thereof having counted a series of successive input signals thereto equal to a number which differs from n times said certain odd harmonic by said given odd number of half-cycles of said color-carrier frequency, first coupling means for applying said clock signals as input signals to said scan-line counter, second coupling means for applying said third timing signals as input signals to said field counter, and program control means coupled between said field counter and said scan-line counter for maintaining said scan-line counter in said second programmed condition only in response to said field counter registering that particular count which corresponds to said selected single scan line of a field and for maintaining said scan-line counter in its first programmed condition in response to said field counter registering a count other than said particular count.

6. The system defined in claim 5 wherein said predetermined whole number is 262, said specified color-carrier frequency is the NTSC standard of nominally 3.579545 megahertz, and said odd harmonic is 455n.

7. The system defined in claim 6, wherein the value of n is one and said given odd number of half-cycles of said color-carrier frequency is seven.

8. The system defined in claim 7, wherein said scan-line counter is comprised of a non-programmable counter cascaded with a programmable counter, said non-programmable counter being a divide-by-seven counter and said programmable counter being a divide-by-sixty-five in said first programmed condition thereof and a divide-by-sixty-four is said second programmed condition thereof.

9. The system defined in claim 3, wherein said composite video signal defines character information that is to be displayed in dot matrix form within each of two-dimensional character spaces, each character space having a first-dimension size along a scan-line equal to a first assigned number of successive dot periods and a second-dimension size substantially orthogonal to a scan-line equal to a second assigned number of successive scan-lines, wherein said timing circuitry includes means for deriving dot-timing signals having a given dot period, first-dimension character counting means responsive to said dot-timing signals applied thereto for deriving a first-dimension character timing signal having a period substantially equal to said first assigned number of successive dot periods and second-dimension character counting means responsive to said third timing signals applied thereto for deriving a second-dimension character timing signal having a period substantially equal to said second assigned number of successive third timing signals.

10. The system defined in claim 9, wherein said timing control means includes a field counter for producing said second timing signal in response to said field counter having counted a series of successive input signals thereto equal in number to said predetermined even whole number, a programmable scan-line counter for producing a third timing signal in response to said scan-line counter (1) in a first programmed condition thereof having counted a series of successive input signals thereto equal in number to n times said certain odd harmonic and (2) in a second programmed condition thereof having counted a series of successive input signals thereto equal to a number which differs from n times said certain odd harmonic by said given odd number of half-cycles of said specified color-carrier frequency, first coupling means for applying said clock signals as input signals to said scan-line counter, second coupling means for applying said third timing signals as input signals to said field counter, and program control means coupled between said field counter and said scan-line counter for maintaining said scan-line counter in said second programmed condition only in response to said field counter registering that particular count which corresponds to said selected single scan-line of a field and for maintaining said scan-line counter in its first programmed condition in response to said field counter registering a count other than said particular count.

11. The system defined in claim 9, wherein said means for deriving dot-timing signals includes a keyed dot oscillator generating dot-timing signals having a period greater than half of that of said color-carrier frequency and many times smaller than that of a scan-line, and means for applying said third timing signals as a keying input to said dot oscillator to momentarily key off said dot oscillator at the end of each scan-line.

* * * * *